US008985091B2

(12) United States Patent
Miao

(10) Patent No.: US 8,985,091 B2
(45) Date of Patent: Mar. 24, 2015

(54) DOUBLE LINKAGE TRIGGERING SYSTEM USED FOR CROSSBOW

(71) Applicant: Jiaozuo Sanlida Archery Equipment Corporation, Jiaozuo (CN)

(72) Inventor: Beizhan Miao, Henan Province (CN)

(73) Assignee: Jiaozuo Sanlida Recreation Equipment Co., Ltd. (CN)

( * ) Notice: Subject to any disclaimer, the term of this patent is extended or adjusted under 35 U.S.C. 154(b) by 0 days.

(21) Appl. No.: 13/873,946

(22) Filed: Apr. 30, 2013

(65) Prior Publication Data

US 2014/0182573 A1 Jul. 3, 2014

(30) Foreign Application Priority Data

Dec. 28, 2012 (CN) ..... 2012 2 0733421 U

(51) Int. Cl.

| | |
|---|---|
| ***F41B 5/12*** | (2006.01) |
| ***F41A 17/46*** | (2006.01) |
| ***F41A 19/10*** | (2006.01) |
| ***F41B 5/18*** | (2006.01) |
| ***F41B 5/14*** | (2006.01) |
| ***F41A 19/12*** | (2006.01) |

(52) U.S. Cl.

CPC ..... *F41B 5/1469* (2013.01); *F41A 19/10* (2013.01); *F41B 5/12* (2013.01); *F41A 19/12* (2013.01)

USPC ..... 124/35.1; 124/25; 124/31; 124/40; 124/86

(58) Field of Classification Search

CPC ..... F41B 5/12; F41B 5/1469; F41B 7/046

USPC ..... 124/25, 31, 35.1, 40, 86

See application file for complete search history.

(56) References Cited

U.S. PATENT DOCUMENTS

| | | | | | |
|---|---|---|---|---|---|
| 4,030,473 | A * | 6/1977 | Puryear | 124/35.1 |
| 4,192,281 | A * | 3/1980 | King | 124/25 |
| 4,716,880 | A * | 1/1988 | Adkins | 124/25 |
| 4,721,092 | A * | 1/1988 | Waiser | 124/40 |
| 4,877,008 | A * | 10/1989 | Troubridge | 124/25 |
| 5,085,200 | A * | 2/1992 | Horton-Corcoran et al. | 124/25 |
| 5,596,976 | A * | 1/1997 | Waiser | 124/25 |
| 5,598,829 | A * | 2/1997 | Bednar | 124/25 |
| 5,619,979 | A * | 4/1997 | Ossege | 124/25 |
| 5,649,520 | A * | 7/1997 | Bednar | 124/25 |
| 5,884,614 | A * | 3/1999 | Darlington et al. | 124/25 |
| 6,205,990 | B1 * | 3/2001 | Adkins | 124/25 |
| 6,425,386 | B1 * | 7/2002 | Adkins | 124/31 |
| 6,736,123 | B1 * | 5/2004 | Summers et al. | 124/25 |

(Continued)

*Primary Examiner* — Gene Kim
*Assistant Examiner* — Alexander Niconovich
(74) *Attorney, Agent, or Firm* — Schwegman Lundberg & Woessner, P.A.

(57) ABSTRACT

Disclosed is a double linkage triggering system including a main body, which has a trigger unit and a shooting unit. The trigger unit is capable of being contacted with the shooting unit. The trigger unit comprises a bracket body, a trigger block, a hammer, a trigger power-adjusting bolt, a triggering mechanism and a trigger-safety device. The hammer is hinge connected to the bracket body. The trigger block is hinge connected to the bracket body and each end of the trigger block is respectively capable of being limited by the hammer and the trigger power-adjusting bolt. The shooting unit has a sight stand, a guide device, a pressure plate, a rotary latch, a roof plate, a latching plate, a returning device, and an anti-empty shooting mechanism. The returning device is inserted into the roof plate. The roof plate is hinge connected to the latching plate.

5 Claims, 1 Drawing Sheet

(56) References Cited

U.S. PATENT DOCUMENTS

| | | | | |
|---|---|---|---|---|
| 6,802,304 | B1 * | 10/2004 | Chang | 124/25 |
| 7,174,884 | B2 * | 2/2007 | Kempf et al. | 124/25 |
| 7,588,022 | B2 * | 9/2009 | Chang | 124/25 |
| 7,726,291 | B2 * | 6/2010 | Pedemonte | 124/20.3 |
| 7,743,543 | B2 * | 6/2010 | Karagias | 42/69.02 |
| 7,770,567 | B1 * | 8/2010 | Yehle | 124/25 |
| 7,810,480 | B2 * | 10/2010 | Shepley et al. | 124/25 |
| 8,020,543 | B2 * | 9/2011 | Maleski et al. | 124/25 |
| 8,091,540 | B2 * | 1/2012 | Matasic et al. | 124/31 |
| 8,240,299 | B2 * | 8/2012 | Kronengold et al. | 124/25 |
| 8,522,761 | B1 * | 9/2013 | Chu | 124/25 |
| 8,578,916 | B2 * | 11/2013 | Maleski et al. | 124/25 |
| 8,651,094 | B2 * | 2/2014 | Matasic et al. | 124/25 |
| 8,770,178 | B2 * | 7/2014 | Kempf | 124/25 |
| 2010/0170489 | A1 * | 7/2010 | Shepley et al. | 124/25 |
| 2014/0102431 | A1 * | 4/2014 | Kennedy | 124/35.1 |
| 2014/0174419 | A1 * | 6/2014 | McPherson et al. | 124/35.1 |

* cited by examiner

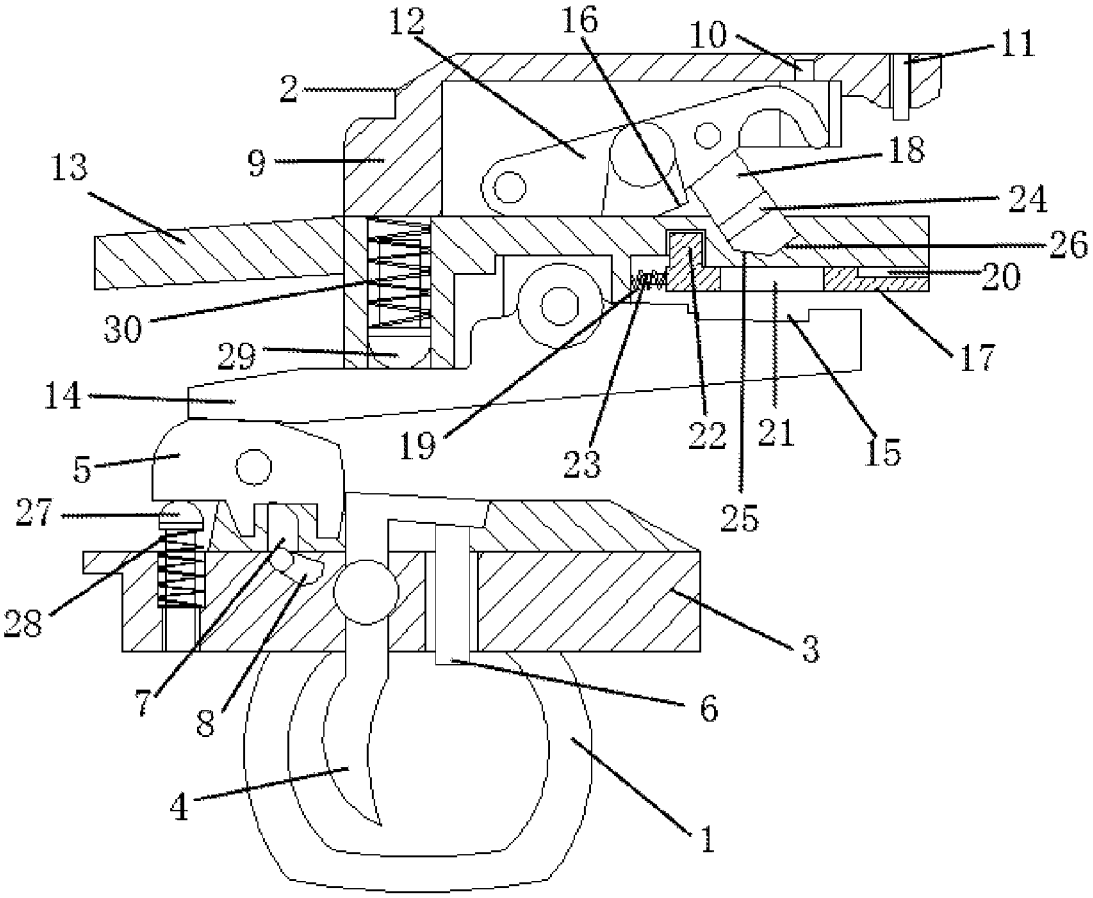
12
16
10
11
2
9
18
13
24
26
20
30
29
17
14
19
23
22
21
15
5
25
27
28
3
7
8
6
4
1

DOUBLE LINKAGE TRIGGERING SYSTEM USED FOR CROSSBOW

PRIORITY CLAINM AND RELATED APPLICATIONS

This application claims the benefit of priority under 35 U.S.C. Section 119 to Chinese Patent Application Serial No. 201220733421.1, filed Dec. 28, 2012, which application is incorporated herein by reference in its entirety.

TECHNICAL FIELD

The Invention relates to a double linkage trigger system used on crossbows in the field of crossbow manufacture.

TECHNICAL BACKGROUND

A crossbow is a kind of sports facilities with extremely strong firing force, of which the firing mechanism includes mainly a trigger system and bowstring and wherein the trigger system is the crucial control device when shooting. Accordingly, the security, the operability and the maintainability of the triggering system might directly affect the efficiency and the safety of the crossbow. The present trigger system adopted in the market is configured as a whole body and it is exceedingly difficult to be assembled or disassembled. Consequently the trigger system is very hard to be maintained and well-used. In addition, a safety device on the crossbow itself is mainly used in order to prevent the arrow from being launched by mistake. However, the effective protection is deficient for the trigger system. Once the safety device on the crossbow itself is broken down or operated by mistake, it will cause error shooting/launching of the arrow and then reduce the safety when using the crossbow.

On the other hand, the arrow always drops off easily due to the restriction of the operating angle and the faulty operation when using the crossbow. Furthermore, even if the arrow is dropped off or is not installed correctly, the shooting of the crossbow is still capable of being performed and it leads to empty shooting accordingly. Although the empty shooting is not harmful to the crossbow body and the user, it will reduce greatly the using efficiency.

SUMMARY

The invention provides a double linkage triggering system used on crossbows for obviating one or more problems mentioned above in the prior art. The invention discloses the following technical features. The double linkage triggering system used on a crossbow includes a main body, which is composed of a trigger unit 1 and a shooting unit 2, wherein the trigger unit 1 is capable of being contacted with the shooting unit 2. The trigger unit 1 comprises a bracket body 3, a trigger block 4, a hammer 5, a trigger power-adjusting bolt 6, a triggering mechanism and a trigger-safety device. The hammer 5 is hinge connected to the bracket body 3 and is capable of being contacted with the triggering mechanism. The trigger block 4 is hinge connected to the bracket body 3 and each end of the trigger block 4 is respectively capable of being limited by the hammer 5 and the trigger power-adjusting bolt 6. The triggering mechanism and trigger power-adjusting bolt 6 are both inserted into the bracket body 3. The trigger-safety device includes a rotating block 7 and a shifting block 8. The rotating block 7 is connected with the shifting block 8 by a bolt and is hinge connected to the bracket body 3, wherein, the rotating block 7 is capable of being contacted with the hammer 5, and the shifting block 8 is arranged outside of the bracket body 3. The shooting unit 2 consists of a sight stand 9, a guide device 10, a pressure plate 11, a rotary latch 12, a roof plate 13, a latching plate 14, a returning device, and an anti-empty shooting mechanism. The returning device is inserted into the roof plate 13 and is capable of being squeezed or impacted with the latching plate 14. Furthermore, the roof plate 13 is hinge connected to the latching plate 14 and a positioning groove 15 is formed on the front end of the latching plate 14. Both of the sight stand 9 and the rotary latch 12 are hinge connected to the roof plate 13, and wherein the rotary latch 12 is located at the interior of the sight stand 9. Consequently two contacting surfaces 16 are formed between the rotary latch 12 and the roof plate 13, between which the angle at the range of 120° to 160° can be created. A guide device 10 and a pressure plate 11 are further provided on the sight stand 9.

The anti-empty shooting mechanism is composed of an arrow placing device 17, a stopblock 18 and a positioning spring 19. An arrow slot 20 is formed on the front end of the upper surface of the arrow placing device 17. A sliding groove 21 is located on the middle section of the arrow placing device 17. A mounting block 22 is equipped on the distal end of the arrow placing device 17 and also, a positioning pin 23 is formed on the surface of the distal end of it. Here, the positioning pin 23 is surrounded by the positioning spring 19 and is capable of being contacted with the roof plate 13. The mounting block 22 is inserted into the roof plate 13. The stopblock 18, with a side face having a fixing groove 24 and a lower surface configured by a wedge-shaped sliding surface 25 and horizontal fixing surface 26, is hinge connected to the rotary latch 12.

The triggering mechanism includes a triggering pin 27 and a triggering spring 28, wherein the triggering pin 27 is surrounded by the triggering spring 28.

The returning device consists of a returning pin 29 and a returning spring 30, wherein the returning pin 29 is surrounded by the returning spring 30.

The invention brings the following technical effects:

(1) The separate-style triggering system is disclosed in the invention, which is both simple and elegant and easy to be assembled or disassembled. The efficiency of the trigger is increased greatly and also the maintenance of the trigger becomes convenient, by which therefore, the reliability and the working life of the crossbow can be improved.

(2) A protecting device is provided for the triggering device in the triggering system. The shooting of the arrow due to the faulty operation is capable of being prevented accordingly. It will also improve the reliability and the security of using the triggering system.

(3) An anti-empty shooting mechanism is further provided in the triggering system, which increases working efficiency of the crossbow.

BRIEF DESCRIPTION OF THE DRAWING

The present disclosure will become more fully understood from the detailed description given herein below for illustration only, and thus are not limitative of the present disclosure, and wherein:

FIG. 1 is a structure diagram of the double linkage triggering system used on crossbows disclosed in the invention.

DETAILED DESCRIPTION

As shown in FIG. 1, the double linkage triggering system used on a crossbow includes a main body, which is composed of a trigger unit 1 and a shooting unit 2, wherein the trigger unit 1 is capable of being contacted with the shooting unit 2. The trigger unit 1 comprises a bracket body 3, a trigger block 4, a hammer 5, a trigger power-adjusting bolt 6, a triggering mechanism and a trigger-safety device. The hammer 5 is hinge connected to the bracket body 3 and is capable of being contacted with the triggering mechanism The trigger block 4 is hinge connected to the bracket body 3 and each end of the trigger block 4 is respectively capable of being limited by the hammer 5 and the trigger power-adjusting bolt 6. Further, the triggering mechanism and trigger power-adjusting bolt 6 are both inserted into the bracket body 3. The trigger-safety device includes a rotating block 7 and a shifting block 8. The rotating block 7 is connected with the shifting block 8 by a bolt and is hinge connected to the bracket body 3, wherein, the rotating block 7 is capable of being counterbalanced to the hammer 5, and the shifting block 8 is arranged outside of the bracket body 3.

Besides, the shooting unit 2 consists of a sight stand 9, a guide device 10, a pressure plate 11, a rotary latch 12, a roof plate 13, a latching plate 14, a returning device, and an anti-empty shooting mechanism. The returning device is inserted into the roof plate 13 and is capable of being squeezed with the latching plate 14. Furthermore, the roof plate 13 is hinge connected to the latching plate 14 and a positioning groove 15 is formed on the front end of the latching plate 14. Both of the sight stand 9 and the rotary latch 12 are hinge connected to the roof plate 13, and wherein the rotary latch 12 is located at the interior of the sight stand 9. Consequently two contacting surfaces 16 are formed between the rotary latch 12 and the roof plate 13, between which the angle at the range of 120° to 160° can be created. Preferably, a guide device 10 and a pressure plate 11 are provided on the sight stand 9.

Further, the anti-empty shooting mechanism is composed of an arrow placing device 17, a stopblock 18 and a positioning spring 19. An arrow slot 20 is formed on the front end of the upper surface of the arrow placing device 17. A sliding groove 21 is located on the middle section of the arrow placing device 17. A mounting block 22 is equipped on the distal end of the arrow placing device 17 and also, a positioning pin 23 is formed on the surface of the distal end of it. Here, the positioning pin 23 is surrounded by the positioning spring 19 and is capable of being squeezed with the roof plate 13. The mounting block 22 is inserted into the roof plate 13. The stopblock 18, with a side face having a fixing groove 24 and a lower surface configured by a wedge-shaped sliding surface 25 and horizontal fixing surface 26, is hinge connected to the rotary latch 12. The triggering mechanism includes a triggering pin 27 and a triggering spring 28, wherein the triggering pin 27 is surrounded by the triggering spring 28. The returning device consists of a returning pin 29 and a returning spring 30, wherein the returning pin 29 is surrounded by the returning spring 30.

What is claimed is:

1. A double linkage triggering system used on a crossbow, characterized in that, said triggering system includes a main body, which is composed of a trigger unit and a shooting unit, wherein the trigger unit and shooting unit are separately mounted to the crossbow;

the trigger unit comprises:

a bracket body, a trigger block, a hammer, a trigger power-adjusting bolt, a triggering mechanism and a trigger-safety device;

the hammer is hinge connected to the bracket body and the triggering mechanism is configured to rotate the hammer from a starting position to a firing position;

the trigger block is hinge connected to the bracket body and each end of the trigger block is respectively limited by the hammer and the trigger power-adjusting bolt;

the triggering mechanism and trigger power-adjusting bolt are located in the bracket body;

the trigger-safety device includes a rotating block and a shifting block;

the rotating block is connected with the shifting block by a bolt and is hinge connected to the bracket body, wherein, the rotating block is counterbalanced to the hammer, and, the shifting block is arranged outside of the bracket body;

the shooting unit comprises:

a sight stand, a guide device, a pressure plate, a rotary latch, a roof plate, a latching plate, a returning device, and an anti-empty shooting mechanism;

the returning device is inserted into the roof plate and is counterbalanced to the latching plate, and furthermore, the roof plate is hinge connected to the latching plate and a positioning groove is formed on a front end of the latching plate, wherein the triggering mechanism is configured to move the hammer of the separately mounted trigger unit to pivot the latching plate of the separately mounted shooting unit;

both of the sight stand and the rotary latch are hinge connected to the roof plate, wherein the rotary latch is located at an interior of the sight stand and two contacting surfaces are formed between the rotary latch and the roof plate at an angle of 120° to 160° and any angle therebetween; and the guide device and the pressure plate are further provided on the sight stand.

2. A double linkage triggering system used on a crossbow according to claim 1, characterized in that, said triggering system further includes the anti-empty shooting mechanism, further comprising an arrow placing device, a stopblock and a positioning spring;

an arrow slot is formed on the front end of an upper surface of the arrow placing device;

| | | |
|---|---|---|
| 1. trigger unit | 2. shooting unit | 3. bracket body |
| 4. trigger block | 5. hammer | 6. trigger power-adjusting bolt |
| 7. rotating block | 8. shifting block | 9. sight stand |
| 10. guide device | 11. pressure plate | 12. rotary latch |
| 13. roof plate | 14. latching plate | 15. positioning groove |
| 16. contacting surface | 17. arrow placing device | 18. stopblock |
| 19. positioning spring | 20. arrow slot | 21. sliding groove |
| 22. mounting block | 23. positioning pin | 24. fixing groove |
| 25. wedge-shaped sliding surface | 26. horizontal fixing surface | 27. triggering pin |
| 28. triggering spring | 29. returning pin | 30. returning spring |

a sliding groove is located on a middle section of the arrow placing device;

a mounting block and a positioning pin are located on a distal end of the arrow placing device;

the positioning pin is surrounded by the positioning spring and is contacted with the roof plate;

the mounting block is inserted into the roof plate;

the stopblock, with a side face having a fixing groove and a lower surface configured by both a wedge-shaped sliding surface and a horizontal fixing surface, is hinge connected to the rotary latch.

3. A double linkage triggering system used on a crossbow according to claim 1, characterized in that, the triggering mechanism includes a triggering pin and a triggering spring, wherein the triggering pin is surrounded by the triggering spring.

4. A double linkage triggering system used on a crossbow according to claim 2, the returning device consists of a returning pin and a returning spring, wherein the returning pin is surrounded by the returning spring.

5. The double linkage triggering system of claim 1, further comprising a shooting unit that is separate from the trigger unit.

* * * * *

UNITED STATES PATENT AND TRADEMARK OFFICE

CERTIFICATE OF CORRECTION

PATENT NO. : 8,985,091 B2
APPLICATION NO. : 13/873946
DATED : March 24, 2015
INVENTOR(S) : Beizhan Miao It is certified that error appears in the above-identified patent and that said Letters Patent is hereby corrected as shown below:

On the title page, in item (30), in "Foreign Application Priority Data", in column 1, line 1, delete "2012 2 0733421 U" and insert --201220733421.1--, therefor Signed and Sealed this
First Day of September, 2015

Michelle K. Lee

Michelle K. Lee
*Director of the United States Patent and Trademark Office*